US008307903B2

(12) United States Patent
Redlinger et al.

(10) Patent No.: US 8,307,903 B2
(45) Date of Patent: Nov. 13, 2012

(54) METHODS AND APPARATUS FOR SUBSEA WELL INTERVENTION AND SUBSEA WELLHEAD RETRIEVAL

(75) Inventors: Thomas M. Redlinger, Houston, TX (US); Andrew Antoine, Houston, TX (US); My Le, Sugar Land, TX (US); Richard J. Segura, Cypress, TX (US)

(73) Assignee: Weatherford / Lamb, Inc., Houston, TX (US)

( * ) Notice: Subject to any disclaimer, the term of this patent is extended or adjusted under 35 U.S.C. 154(b) by 478 days.

(21) Appl. No.: 12/490,508

(22) Filed: Jun. 24, 2009

(65) Prior Publication Data

US 2010/0326665 A1 Dec. 30, 2010

(51) Int. Cl.
*E21B 29/12* (2006.01)
*E21B 23/00* (2006.01)

(52) U.S. Cl. ..... 166/341; 166/338; 166/351; 166/361; 166/368; 166/298; 285/81

(58) Field of Classification Search ..... 166/341, 166/338–340, 351, 352, 361, 368, 297, 298, 166/55, 55.7; 285/80–82
See application file for complete search history.

(56) References Cited

U.S. PATENT DOCUMENTS

| | | | | |
|---|---|---|---|---|
| 1,867,289 | A | 7/1932 | Ventresca | |
| 2,687,323 | A | 8/1954 | Stohn | |
| 3,052,024 | A | 9/1962 | Courtney | |
| 3,325,190 | A * | 6/1967 | Eckert et al. | 285/18 |
| 3,338,305 | A | 8/1967 | Pittman et al. | |
| 3,376,927 | A | 4/1968 | Brown | |
| 3,732,924 | A | 5/1973 | Chelette et al. | |
| 3,782,459 | A | 1/1974 | Murray | |
| 3,848,667 | A | 11/1974 | Clark, Jr. | |
| 3,983,936 | A * | 10/1976 | Kennard et al. | 166/361 |

(Continued)

FOREIGN PATENT DOCUMENTS

GB 1184480 A 3/1970

(Continued)

OTHER PUBLICATIONS

Norse Cutting & Abandonment, Inc., The World Leading Decommissioning Specialists, 2007.

(Continued)

*Primary Examiner* — Matthew Buck
(74) *Attorney, Agent, or Firm* — Patterson & Sheridan, L.L.P.

(57) ABSTRACT

The present invention generally relates to methods and apparatus for subsea well intervention operations, including retrieval of a wellhead from a subsea well. In one aspect, a method of performing an operation in a subsea well is provided. The method comprising the step of positioning a tool proximate a subsea wellhead. The tool has at least one grip member and the tool is attached to a downhole assembly. The method also comprising the step of clamping the tool to the subsea wellhead by moving the at least one grip member into engagement with a profile on the subsea wellhead. The method further comprising the step of applying an upward force to the tool thereby enhancing the grip between the grip member and the profile on the subsea wellhead. Additionally, the method comprising the step of performing the operation in the subsea well by utilizing the downhole assembly. In another aspect, an apparatus for use in a subsea well is provided. In a further aspect, a method of cutting a casing string in a subsea well is provided.

16 Claims, 11 Drawing Sheets

U.S. PATENT DOCUMENTS

| | | | | | |
|---|---|---|---|---|---|
| 4,181,196 | A | * | 1/1980 | Darby et al. | 166/361 |
| 4,191,255 | A | * | 3/1980 | Rives | 166/297 |
| 4,496,172 | A | * | 1/1985 | Walker | 285/18 |
| 4,550,781 | A | * | 11/1985 | Kagler, Jr. | 166/340 |
| 4,557,508 | A | * | 12/1985 | Walker | 285/84 |
| 4,606,557 | A | * | 8/1986 | Coffey | 285/18 |
| 4,610,570 | A | * | 9/1986 | Brockway | 405/224 |
| 4,703,802 | A | * | 11/1987 | Bryan et al. | 166/298 |
| 4,708,376 | A | * | 11/1987 | Jennings et al. | 285/315 |
| 4,823,879 | A | * | 4/1989 | Brammer et al. | 166/341 |
| 4,883,118 | A | | 11/1989 | Preston | |
| 4,900,198 | A | * | 2/1990 | Hoaki | 405/303 |
| 4,969,514 | A | * | 11/1990 | Morris et al. | 166/55 |
| 5,101,895 | A | | 4/1992 | Gilbert | |
| 5,146,989 | A | * | 9/1992 | Rouse | 166/339 |
| 5,253,710 | A | | 10/1993 | Carter et al. | |
| 5,273,117 | A | * | 12/1993 | Reimert | 166/348 |
| 5,318,115 | A | * | 6/1994 | Rouse | 166/55.7 |
| 5,791,418 | A | * | 8/1998 | Milberger et al. | 166/368 |
| 5,823,255 | A | | 10/1998 | Swiatowy et al. | |
| 5,848,643 | A | | 12/1998 | Carbaugh et al. | |
| 5,947,642 | A | * | 9/1999 | Teixeira et al. | 405/195.1 |
| 6,029,745 | A | * | 2/2000 | Broussard et al. | 166/298 |
| 6,056,049 | A | * | 5/2000 | Davis | 166/55.7 |
| 6,330,919 | B1 | * | 12/2001 | McGarian | 166/361 |
| 6,357,528 | B1 | * | 3/2002 | Davis et al. | 166/339 |
| 6,478,088 | B1 | | 11/2002 | Hansen et al. | |
| 6,554,073 | B2 | * | 4/2003 | McGarian | 166/361 |
| 6,626,470 | B1 | * | 9/2003 | Appleford et al. | 285/320 |
| 6,629,565 | B2 | * | 10/2003 | Harrell | 166/361 |
| 6,805,382 | B2 | * | 10/2004 | Jennings | 285/18 |
| 6,827,150 | B2 | | 12/2004 | Luke | |
| 6,845,815 | B2 | * | 1/2005 | Hergarden et al. | 166/92.1 |
| 7,028,777 | B2 | * | 4/2006 | Wade et al. | 166/343 |
| 7,090,019 | B2 | * | 8/2006 | Barrow et al. | 166/361 |
| 7,178,598 | B2 | | 2/2007 | Lund et al. | |
| 7,614,453 | B2 | * | 11/2009 | Spiering et al. | 166/338 |
| 7,686,087 | B2 | * | 3/2010 | Pallini et al. | 166/367 |
| 7,757,754 | B2 | * | 7/2010 | McKay | 166/55.7 |
| 8,056,633 | B2 | * | 11/2011 | Barra et al. | 166/298 |
| 2009/0050310 | A1 | | 2/2009 | McKay | |

FOREIGN PATENT DOCUMENTS

| | | | |
|---|---|---|---|
| GB | 2159855 | A | 12/1985 |
| GB | 2259930 | A | 3/1993 |
| GB | 2310873 | A | 9/1997 |
| WO | WO 91/02138 | | 2/1991 |
| WO | WO 99/37877 | | 7/1999 |
| WO | WO 2009/028953 | | 3/2009 |
| WO | WO 2009/122202 | | 10/2009 |
| WO | WO 2009/122203 | | 10/2009 |

OTHER PUBLICATIONS

Australian Office Action for Patent Application No. 2010202631 dated Feb. 10, 2012.

European Search Report and Written Opinion; EP Application No. 10251128.4; Jul. 19, 2012.

* cited by examiner

METHODS AND APPARATUS FOR SUBSEA WELL INTERVENTION AND SUBSEA WELLHEAD RETRIEVAL

BACKGROUND OF THE INVENTION

1. Field of the Invention

Embodiments of the present invention generally relate to a subsea well. More particularly, embodiments of the invention relate to methods and apparatus for subsea well intervention operations, including retrieval of a wellhead from a subsea well.

2. Description of the Related Art

After the production of a subsea well is finished, the subsea well is closed and abandoned. The subsea well closing process typically includes recovering the wellhead from the subsea well using a conventional wellhead retrieval operation. During the conventional wellhead retrieval operation, a retrieval assembly equipped with a casing cutter is lowered on a work string from a floating rig until the retrieval assembly is positioned over the subsea wellhead. Next, the casing cutter is lowered into the wellbore as the retrieval assembly is lowered onto the wellhead. The casing cutter is actuated to cut the casing by using the work string. The cutter may be powered by rotating the work string from the floating rig. Since the work string is used to manipulate the retrieval assembly and the casing cutter, the floating rig is required at the surface to provide the necessary support and structure for the work string. Even though the subsea wellhead may be removed in this manner, the use of the floating rig and the work string can be costly and time consuming. Therefore, there is a need for an improved method and apparatus for subsea wellhead retrieval.

SUMMARY OF THE INVENTION

The present invention generally relates to methods and apparatus for subsea well intervention operations, including retrieval of a wellhead from a subsea well. In one aspect, a method of performing an operation in a subsea well is provided. The method comprises the step of positioning a tool proximate a subsea wellhead. The tool has at least one grip member and the tool is attached to a downhole assembly. The method also comprises the step of clamping the tool to the subsea wellhead by moving the at least one grip member into engagement with a profile on the subsea wellhead. The method further comprises the step of applying an upward force to the tool thereby enhancing the grip between the grip member and the profile on the subsea wellhead. Additionally, the method comprises the step of performing the operation in the subsea well by utilizing the downhole assembly.

In another aspect, an apparatus for use in a subsea well is provided. The apparatus comprises a grip member movable between an unclamped position and a clamped position, wherein the grip member in the clamped position applies a grip force to a profile on the subsea wellhead. Additionally, the apparatus comprises a lifting assembly configured to generate an upward force which increases the grip force applied by the grip member.

In yet another aspect, a method of performing an operation in a subsea well is provided. The method comprises the step of positioning a tool proximate a subsea wellhead. The tool has at least one grip member and a lock member. The tool is also attached to a downhole assembly. The method further comprises the step of moving the at least one grip member from an unclamped position to a clamped position in which the grip member engages the subsea wellhead. The method also comprises the step of hydraulically activating the lock member such that the lock member engages a portion of the grip member thereby retaining the grip member in the clamped position. Additionally, the method comprises the step of performing the operation in the subsea well by utilizing the downhole assembly.

In a further aspect, an apparatus for use in a subsea well is provided. The apparatus comprises a grip member for engaging a subsea wellhead, wherein the grip member is movable between an unclamped position and a clamped position. The apparatus further comprises a lock member movable between an unlocked position and a locked position upon activation of a hydraulic cylinder, wherein the lock member in the locked position retains the grip member in the clamped position.

In a further aspect, a method of cutting a casing string in a subsea well is provided. The method comprises the step of positioning a tool proximate a subsea wellhead. The tool has at least one grip member and the tool is attached to a cutting assembly. The method further comprises the step of operating the at least one grip member to clamp the tool to the subsea wellhead. The method also comprises the step of cutting the casing string below the subsea wellhead by utilizing the cutting assembly. Additionally, the method comprises the step of applying an upward force to the tool during the cutting of the casing string which is at least equal to an axial reaction force generated from cutting the casing string, wherein at least a portion of the upward force is created by a cylinder member in the tool that acts on the subsea wellhead.

In yet a further aspect, an apparatus for cutting a casing string in a subsea well is provided. The apparatus comprises a cutting assembly configured to cut the casing string. The apparatus also comprises a grip member for engaging a subsea wellhead, the grip member movable between an unclamped position and a clamped position. Additionally, the apparatus comprises a lifting assembly configured to generate an upward force which is at least equal to an axial reaction force generated from cutting the casing string, wherein the lifting assembly comprises a cylinder and piston arrangement that is configured to act upon a portion of the subsea wellhead.

Additionally, a method of gripping a subsea wellhead is provided. The method comprises the step of positioning a tool proximate the subsea wellhead. The tool has at least one grip member. The method further comprises the step of clamping the tool to the subsea wellhead by moving the at least one grip member into engagement with a profile on the subsea wellhead. Additionally, the method comprises the step of applying an upward force to the tool thereby enhancing the grip between the grip member and the profile on the subsea wellhead.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to methods and apparatus for subsea well intervention operations, including retrieval of a wellhead from a subsea well. To better understand the aspects of the present invention and the methods of use thereof, reference is hereafter made to the accompanying drawings.

Figure 1:
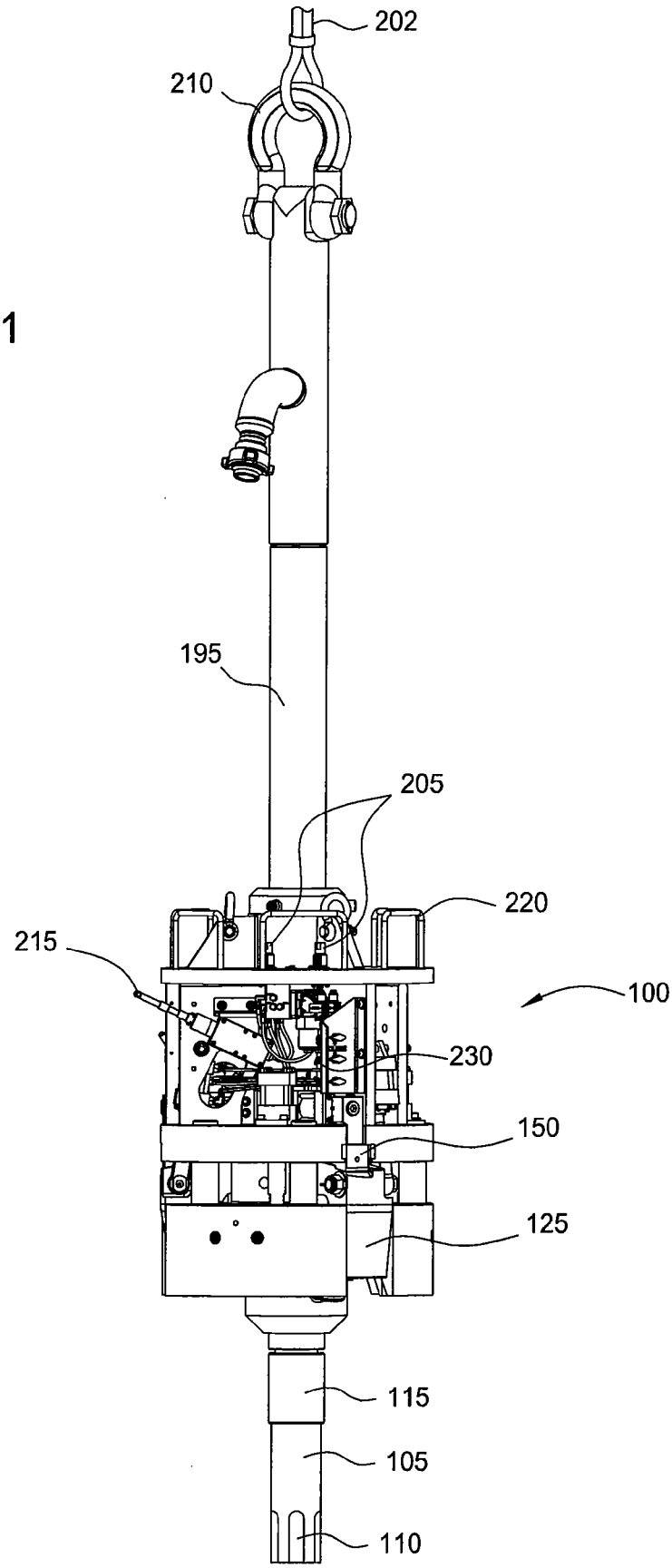
FIG. 1 is an isometric view of a subsea wellhead intervention and retrieval tool according to one embodiment of the invention.

FIG. 1 shows a subsea wellhead intervention and retrieval tool 100 according to one embodiment of the invention. As shown, the tool 100 includes a shackle 210 and a mandrel 195 for connection to a conveyance member 202, such as a cable. The use of cable with the tool 100 allows for greater flexibility because the cable may be deployed from an offshore location that includes a crane rather than using a floating rig with a work string as in the conventional wellhead retrieval operation. In another embodiment, the conveyance member may be an umbilical, coil tubing, wireline or jointed pipe.

The conveyance member 202 is used to lower the tool 100 into the sea to a position adjacent the subsea wellhead. A power source (not shown), such as a hydraulic pump, pneumatic pump or a electrical control source, is attached to the tool 100 via an umbilical cord (not shown) connected to connectors 205 to manipulate and/or monitor the operation of the tool 100. The power source is attached to a control system 230 of the tool 100. The control system 230 may include a manifold arrangement that integrates one or more cylinders of the tool 100. The manifold arrangement may include a filtration system and a plurality of pilot operated check valves which allows the cylinders of the tool to function in a forward direction or a reverse direction. In one embodiment, the manifold arrangement allows the cylinders to operate independently from the other components in the tool 100. The functionality of the cylinders will be discussed herein. The control system 230 may also include data sensors, such as pressure sensors and temperature sensors that generate data regarding the components of the tool 100. The data may be used to monitor the operation of the tool 100 and/or control the components of the tool 100. Further, the data may be used locally by an onboard computer or by the ROV. The data may also be used remotely by sending the data back to the surface via the ROV or via an umbilical attached to the tool.

The power source for controlling the control system 230 of the tool 100 is typically located near the surface. The power source may be configured to pump fluid from the offshore location through the umbilical cord connected to the connectors 205 in order to operate the components of the tool 100 such as arms 125 and wedge blocks 150 as described herein. In another embodiment, the tool 100 may be manipulated using a remotely operated underwater vehicle (ROV). In this embodiment, the ROV may attach to the tool 100 via a stab connector 215 and then control the control system 230 of the tool 100 in a similar manner as described herein. The ROV may also manipulate the position of the tool 100 relative to the wellhead by using handler members 220.

As illustrated in FIG. 1, the tool 100 may be attached to a downhole assembly such as a motor 115 and a rotary cutter assembly 105. The motor 115 may be an electric motor or a hydraulic motor such as a mud motor. The rotary cutter assembly 105 includes a plurality of blades 110 which are used to cut the casing. The blades 110 are movable between a retracted position and an extended position. In another embodiment, the tool 100 may use an abrasive cutting device to cut the casing instead of the rotary cutter assembly 105. The abrasive cutting device may include a high pressure nozzle configured to output high pressure fluid to cut the casing. The use of abrasive cutting technology allows the tool 100 to cut through the casing with substantially no downward pull or torque transmission to the wellhead which is common with the rotary cutter assembly 105. In another embodiment, the tool 100 may use a high energy source such as laser, high power light, or plasma to cut the casing. The high energy cutting system may be incorporated into the tool 100 or conveyed to or through the tool 100 via a transmission system. Suitable cutting systems may use well fluids, and/or water to cut through multiple casings, cement and voids. The cutting systems may also reduce downward pull and subsequent reactive torque transmission to the wellhead.

Figure 2:
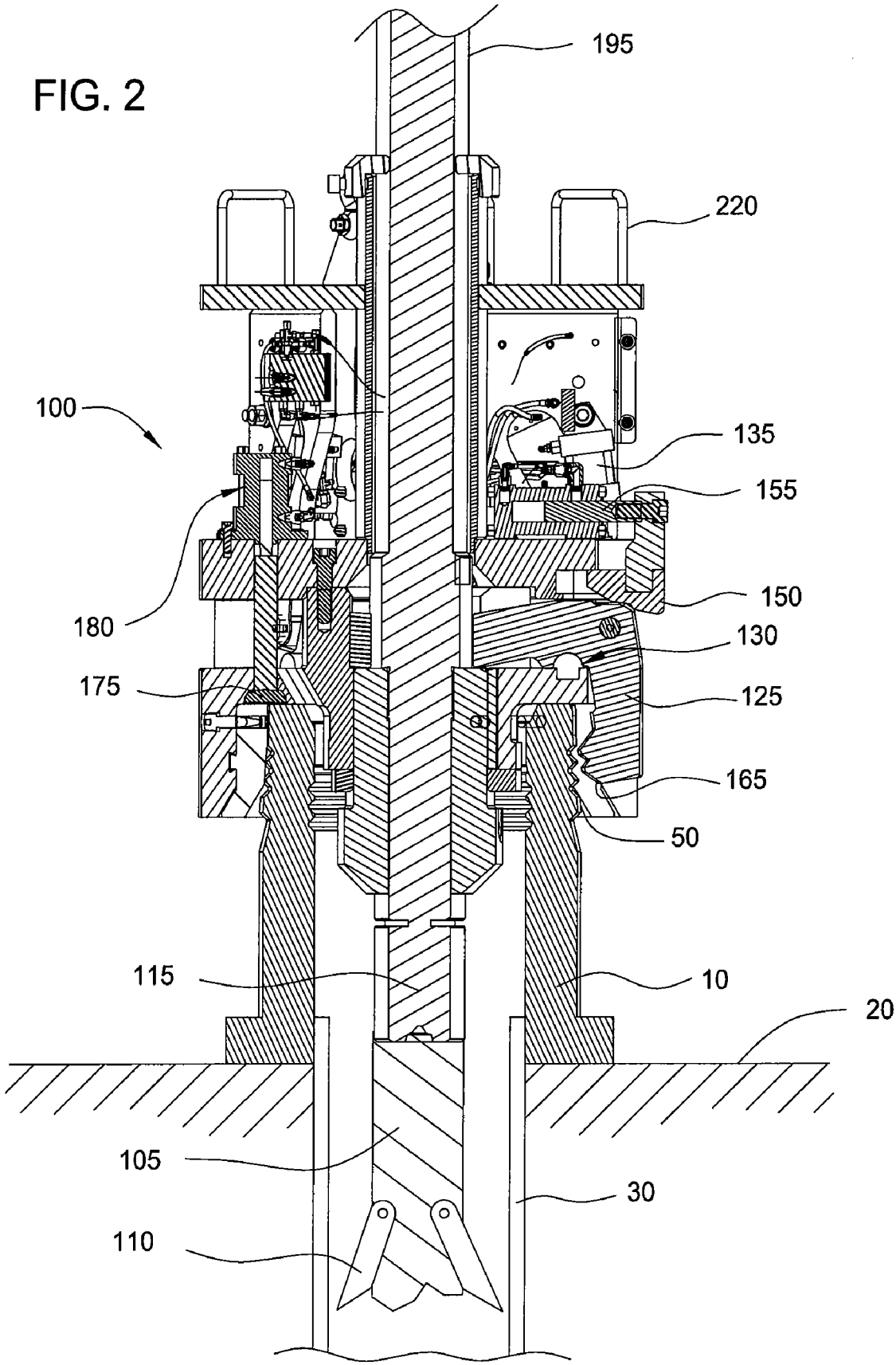
FIG. 2 is a view illustrating the placement of the tool on a wellhead.

FIG. 2 is a view illustrating the placement of the tool 100 on a wellhead 10. The tool 100 is lowered via the conveyance member until the tool 100 is positioned proximate the top of the wellhead 10 disposed on a seafloor 20. As the tool 100 is positioned relative to the wellhead 10, the motor 115 and the cutter assembly 105 are lowered into the wellhead 10 such that the blades 110 of the cutter assembly 105 are adjacent the casing string 30 attached to the wellhead 10. Generally, the wellhead 10 includes a profile 50 at an upper end. The profile 50 may have different configurations depending on which company manufactured the wellhead 10. The arms 125 of the tool 100 include a matching profile 165 to engage the wellhead 10 during the wellhead retrieval operation. It should be noted that the arms 125 or the profile 165 on the arms 125 may be changed (e.g., removed and replaced) with a different profile in order to match the specific profile on the wellhead 10 of interest. The arms 125 are shown in an unclamped position in FIG. 2 and in a clamped position in FIG. 3.

Figure 3:
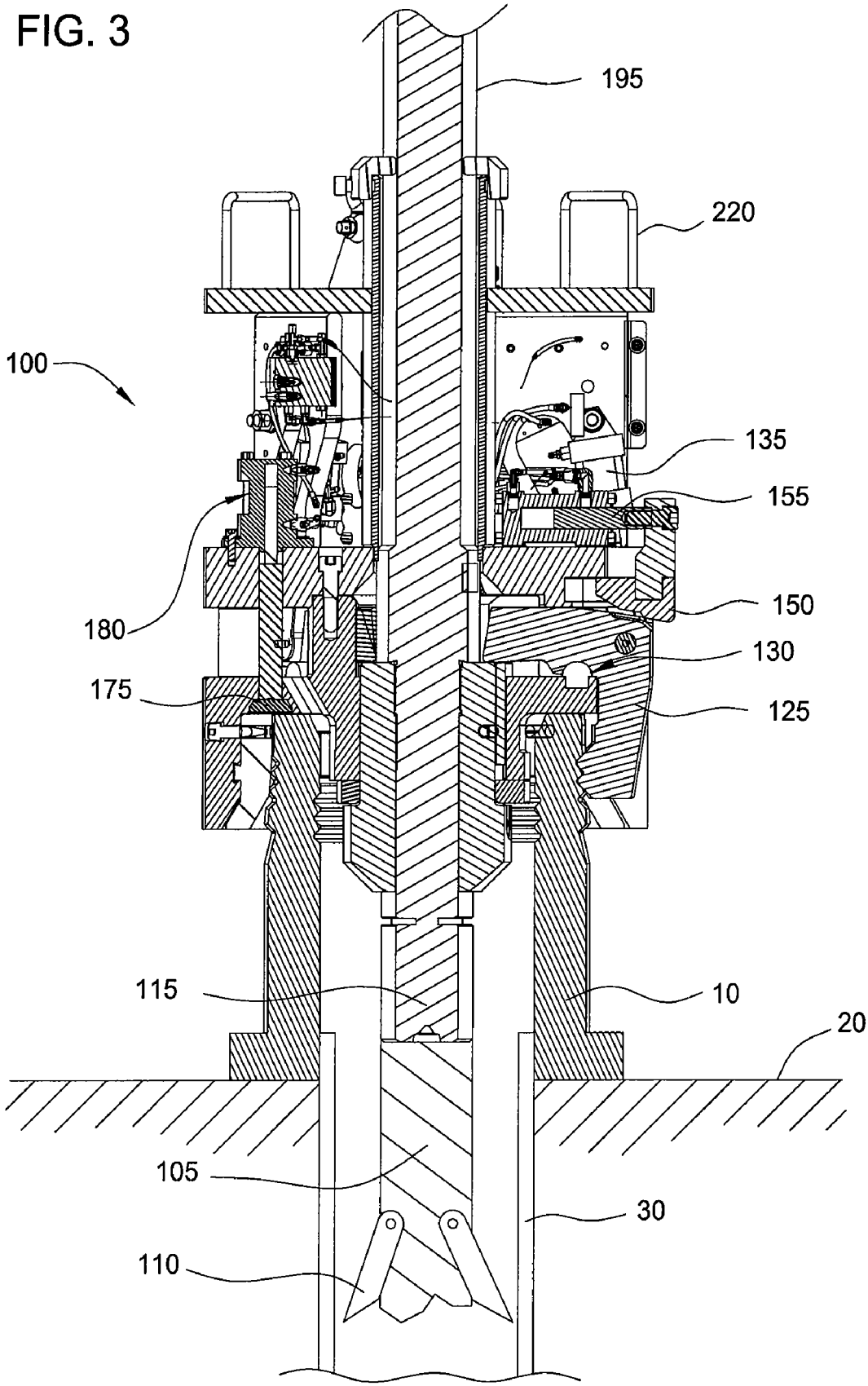
FIG. 3 is a view illustrating the tool engaging the wellhead.
Figure 4:
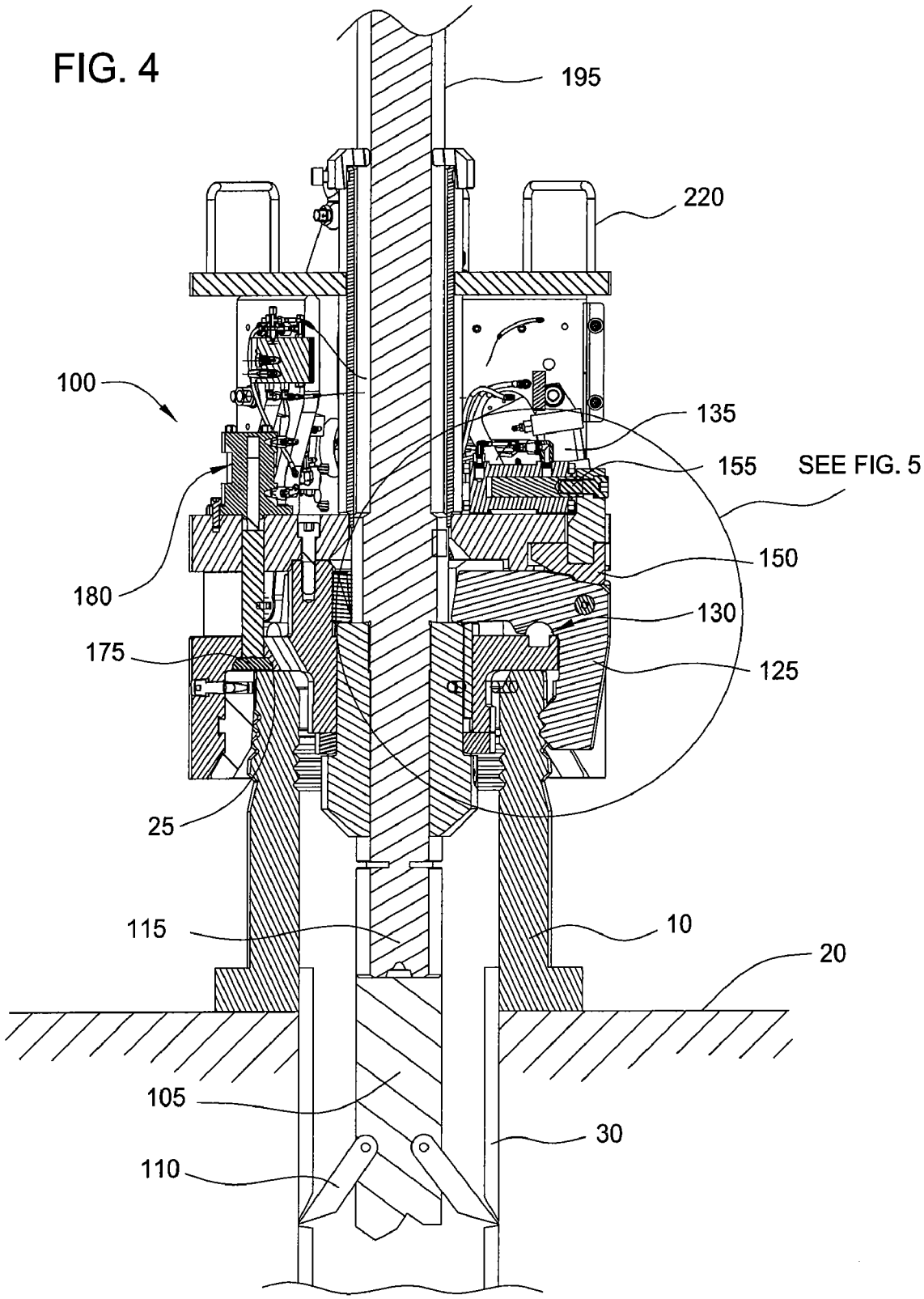
FIG. 4 is a view illustrating the tool cutting a casing string below the wellhead.

FIG. 3 illustrates the tool 100 engaging the wellhead 10. The tool 100 includes an actuating cylinder 135 (e.g. piston and cylinder arrangement) that is attached to the arm 125. As the cylinder 135 is actuated by the power system, the arms 125 rotate around pivot 130 from the unclamped position to the clamped position in order to engage the wellhead 10. It must be noted that the arms 125 may be individually activated by a respective cylinder 135 or collectively activated by one or more cylinders. As shown, the profile 165 on the arms 125 mate with the corresponding profile 50 on the wellhead 10. After the arms 125 have engaged the wellhead 10, the arms 125 are locked in place by activating a locking cylinder 155 (e.g. piston and cylinder arrangement) which causes a wedge block 150 to slide along a surface of the arm 125 as shown in FIG. 4. The movement of the wedge block 150 prevents the arms 125 from rotating around the pivot 130 to the clamped position. It must be noted that the wedge blocks 150 may be individually activated by the respective cylinder 155 or collectively activated by one or more cylinders.

FIG. 4 is a view illustrating the tool 100 cutting a casing string 30 below the wellhead 10. After the arms 125 are locked in place by the wedge block 150, an optional cylinder 180 (e.g. piston and cylinder arrangement) is activated that causes a shoe 175 to act upon a surface 25 of the wellhead 10 and axially lift the tool 100 relative to the wellhead 10. The axial movement of the tool 100 relative to the wellhead 10 allows for active clamping of the tool 100 on the wellhead 10. For instance, as the tool 100 moves relative to the wellhead 10, the profile 165 on the arms 125 moves into maximum contact with the profile 50 on the wellhead 10 such that the tool 100 is clamped on the wellhead 10 and will not rotate (or spin) relative to the wellhead 10 when the rotary cutter assembly 105 is in operation. In this respect, reactive torque resistance is provided for the mechanical cutting system. After the tool 100 is fully engaged with the wellhead 10, the motor 115 activates the rotary cutter assembly 105 and the blades 110 move from the retracted position to the extended position as illustrated in FIG. 3 to FIG. 4. Thereafter, the casing string 30 is cut by the rotary cutter assembly 105. It should be noted that the cylinders 135, 155, 180 may be independently operated by the power source or by the ROV. Additionally, it is contemplated that cylinders 135, 155, 180 may include any suitable number of cylinders as necessary to perform the intended function.

Figure 5B:
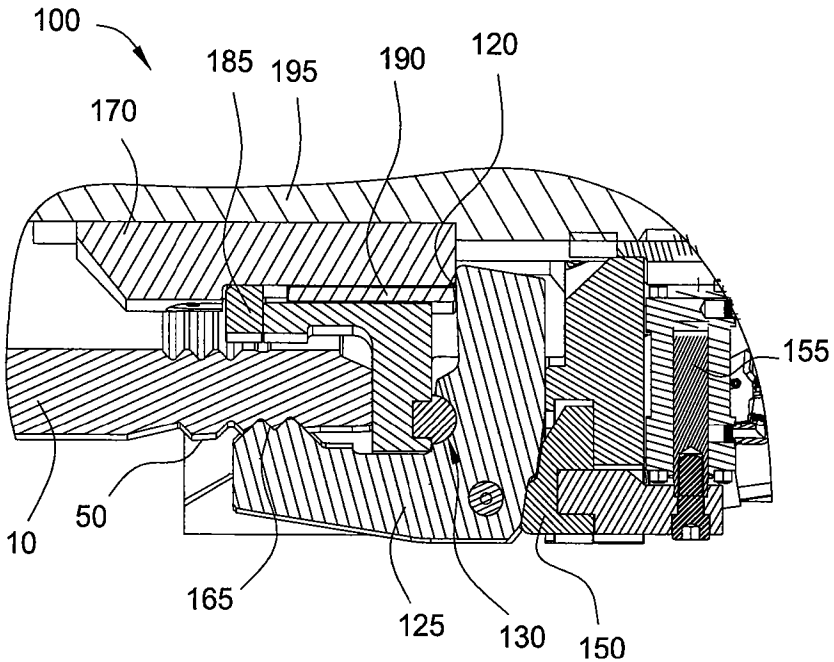
FIGS. 5A and 5B are enlarged views illustrating the components of the tool.
Figure 5A:
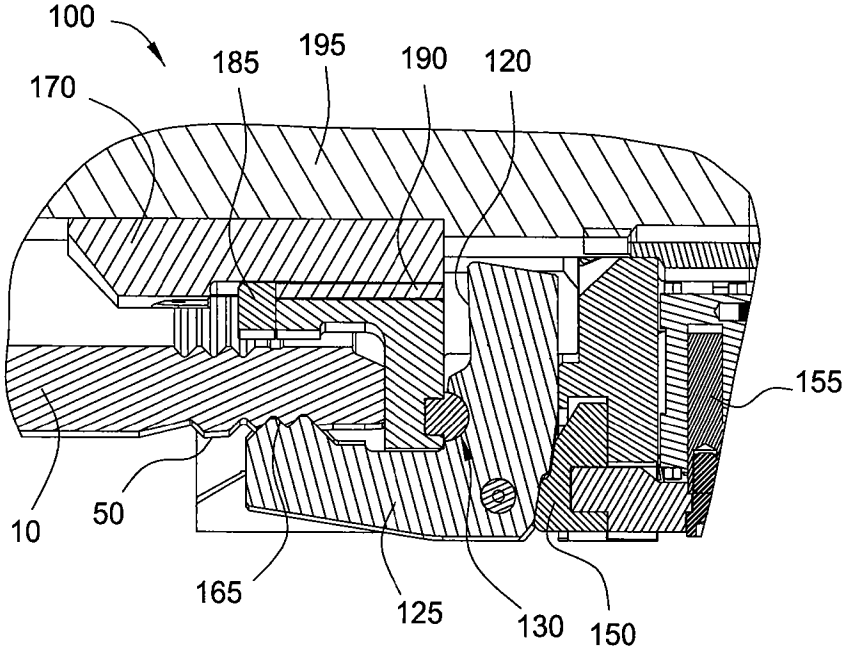

FIGS. 5A and 5B are enlarged views illustrating the components of the tool 100. The conveyance member may be pulled from the surface to enhance the clamping of the tool 100 on the wellhead 10. The upward force applied to the tool 100 by the conveyance member causes an inner mandrel 170 to move from a first position (FIG. 5A) to a second position (FIG. 5B). As illustrated in FIGS. 5A and 5B, the inner mandrel 170 includes a key member 190. It should be noted that the key member 190 may be a separate component attached to the inner mandrel 170 as illustrated or the key member 190 may be formed as part of the mandrel 170 as a single piece. As shown in FIG. 5B, the inner mandrel 170 has moved axially up relative to the wellhead 10. As a result, the inner mandrel 170 (and/or the key member 190) contacts and applies a force to a surface 120 of the arms 125 which increases (or enhances) the gripping force applied by the arms 125 to the profile 50 on the wellhead 10. In other words, the inner mandrel 170 applies the force to the arms 125 and that force is transferred due to the shape of each arm 125 (i.e. lever) and the pivot 130 into the gripping surface which grips the profile 50, thereby enhancing the grip on the profile 50.

The conveyance member connected to the tool 100 may also be pulled from the surface (i.e., offshore location) to create tension in the wellhead 10 and the casing string 30. As the conveyance member is pulled at the surface, the tool 100, the wellhead 10, and the casing string 30 are urged upward relative to the seafloor 20 which creates tension in the wellhead 10 and the casing string 30. The tension created by pulling on the conveyance member may be useful during the cutting operation because tension in the casing string 30 typically prevents the cutters 110 of the rotary cutter assembly 105 from jamming (or become stuck) as the cutters 110 cut through the casing string 30. The upward force created by pulling on the conveyance member is preferably at least equal to any downward force generated during the cutting operation. The upward force is typically maintained during the cutting operation. Optionally, the upward force may also be sufficient to counteract the wellhead assembly deadweight.

During the wellhead retrieval operation, the inner mandrel 170 in the tool 100 may move between the first position as shown in FIG. 5A and the second position as shown in FIG. 5B. In the first position, a portion of the inner mandrel 170 (and/or the key member 190) is positioned proximate a stop block 185 as shown in FIG. 5A. In this position, the inner mandrel 170 has moved axially down relative to the wellhead 10 which typically occurs when the tension in the conveyance member attached to the tool 100 has been minimized. In the second position, a portion of the inner mandrel 170 is positioned proximate the surface 120 of the arms 125. In this position, the inner mandrel 170 has moved axially up relative to the wellhead 10 which typically occurs when the tension in the conveyance member attached to the tool 100 has been increased. Further, in the second position, the inner mandrel 170 (and/or the key member 190) contacts and applies a force to the surface 120 of the arms 125 which increases (or enhances) the gripping force applied by the arms 125 to the profile 50 on the wellhead 10. In other words, the inner mandrel 170 applies the force to the arms 125 and that force is transferred due to the shape of each arm 125 (i.e. lever) and the pivot 130 into the gripping surface which grips the profile 50, thereby enhancing the grip on the profile 50.

Figure 6:
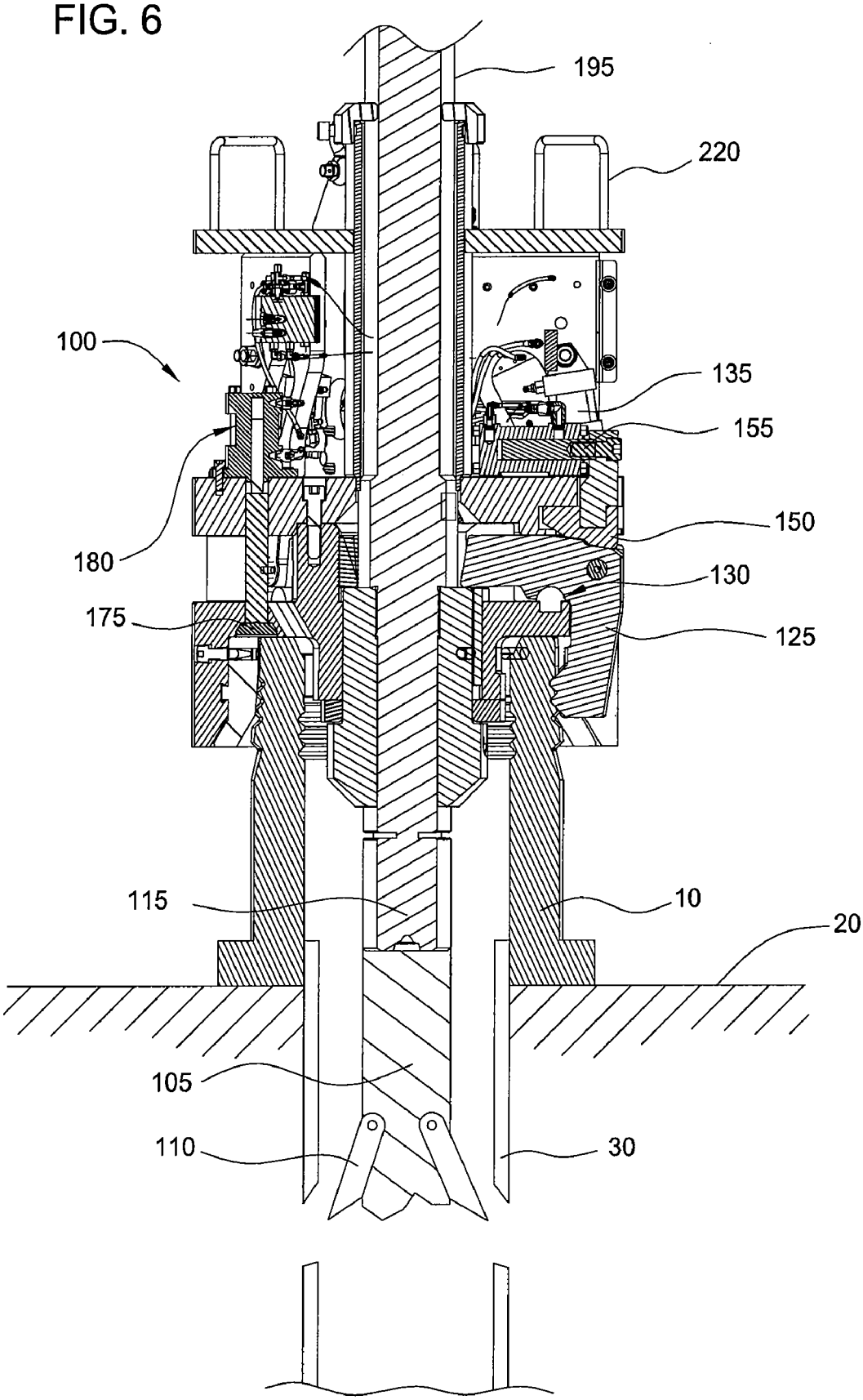
FIG. 6 is a view illustrating the tool after the casing string has been cut.

FIG. 6 is a view illustrating the tool 100 after the casing string 30 has been cut. The cutters 110 on the rotary cutter assembly 105 continue to operate until a lower portion of the casing string 30 is disconnected from an upper portion of the casing string 30. At this point, the rotary cutter assembly 105 is deactivated which causes the cutters 110 to move from the extended position to the retracted position. Next, the tool 100, the wellhead 10, and a portion of the casing string 30 are lifted from the seafloor 20 by pulling on the conveyance member attached to the tool 100 until the wellhead 10 is removed from the sea. After the wellhead 10 is located on the offshore location, such as the floating vessel, the cylinders 135, 155, 180 may be systematically deactivated to release the tool 100 from the wellhead 10.

In operation, the tool 100 is lowered into the sea via the conveyance member until the tool 100 is positioned proximate the top of the wellhead 10 disposed on the seafloor 20. Next, the cylinder 135 is actuated to cause the arms 125 to rotate around pivot 130 to engage the wellhead 10. Subsequently, the arms 125 are locked in place by actuating the cylinder 155 which causes the wedge block 150 to slide along the surface of the arms 125 to prevent the arms 125 from rotating around the pivot 130 to the unclamped position. Thereafter, the cylinder 180 is activated which causes the shoe 175 to act upon the surface 25 of the wellhead 10 and axially lift the tool 100 relative to the wellhead 10. The axial movement of the tool 100 relative to the wellhead 10 allows for active clamping of the tool 100 on the wellhead 10. This sequential function is automatically controlled by the onboard manifold or can be manually sequenced as required by the operator or via a ROV. Next, the conveyance member connected to the tool 100 is pulled from the surface (i.e. offshore location) to create tension on the wellhead assembly 10 and the casing string 30. The motor 115 activates the rotary cutter assembly 105 and the blades 110 move from the retracted position to the extended position to cut through the casing string or multiple casing strings 30. The wellhead assembly deadweight is born mechanically to leverage the load for increased clamping force on the external wellhead profile to maximize reactive torque resistance capability for high torque cutting. Axial load cylinder 180 function to stabilize and preload grip arms during cutting operation. After the casing string 30 is cut, the tool 100, the wellhead 10 and a portion of the casing string 30 is lifted from the seafloor 20 by pulling on the conveyance member attached to the tool 100. When the wellhead 10 is safely located on the offshore location, such as the floating vessel, the cylinders 135, 155, 180 may be systematically deactivated to release the tool 100 from the wellhead 10. At any time during operation, the cylinder function sets 135, 155, 180 may be independently controlled and shut down or reversed for function testing, unsuccessful wellhead release, or maintenance as required through surface controls or remotely using a ROV in case of umbilical failure.

Figure 7:
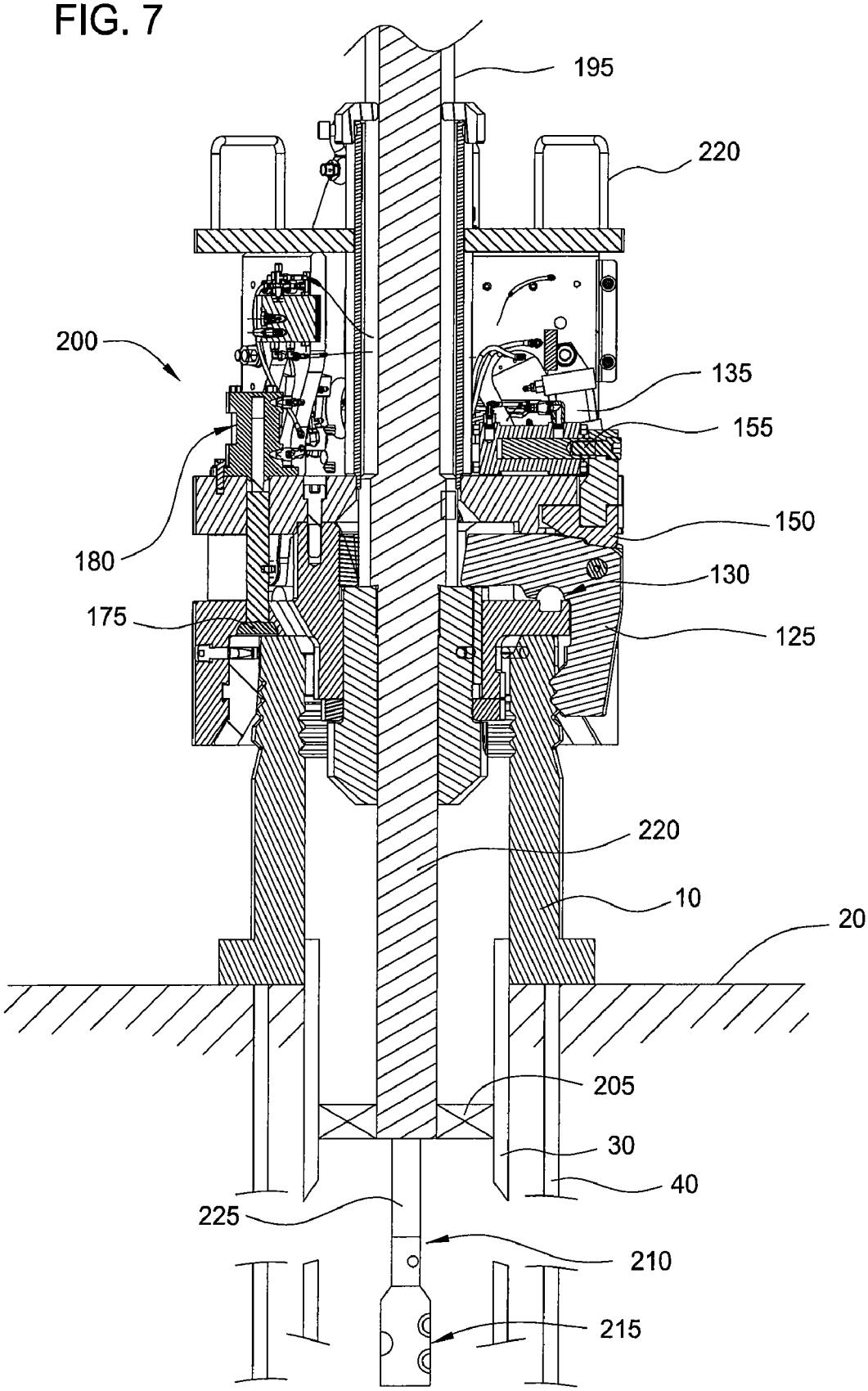
FIG. 7 is a view illustrating a subsea wellhead intervention and retrieval tool with a perforating tool.

FIG. 7 is a view illustrating a subsea wellhead intervention and retrieval tool 200 attached to a perforating tool 215. For convenience, the components of the tool 200 that are similar to the components of the tool 100 will be labeled with the same reference indicator. As shown in FIG. 7, the tool 200 has engaged the wellhead 10 in a similar manner as described herein.

The tool 200 may be attached to an optional packer member 205 that is configured to seal an annulus formed between a tubular member 220 and the casing string 30 attached to the wellhead 10. The packer member 205 may be any type of packer known in art, such as a hydraulic packer or a mechanical packer. The packer member 205 may be used for isolation or well control. Upon activation of the packer member 205, the packer member 205 moves from a first diameter and a second larger diameter. Upon deactivation, the packer member 205 moves from the second larger diameter to the first diameter. The packer member 205 may be activated and deactivated multiple times.

The tool 200 may be attached to an optional ported sub 210 and the perforating tool 215 mounted on a pipe 225. It is to be noted that the pipe 225, the ported sub 210 and the perforating tool 215 may be an integral part of the tool 200 or a separate component that is lowered through the tool 200 via a conveyance member, such as pipe, coiled tubing or an umbilical. Generally, the ported sub 210 may be used in conjunction with the packer member 205 to monitor, control pressure or bleed-off pressure, gas or liquid. The ported sub 210 may also be used to pump cement into the wellbore. In one embodiment, the ported sub 210 is selectively movable between an open position and a closed position multiple times.

The perforating tool 215 is generally a device used to perforate (or punch) the casing string 30 or multiple casing strings, such as casing strings 30, 40. Typically, the perforating tool 215 includes several shaped explosive charges that are selectively activated to perforate the casing string. It is to be noted that the perforating tool 215 may also be used to sever or cut the casing string 30 so that the wellhead 10 may be removed in a similar manner as described herein.

In operation, the tool 200 is lowered into the sea via the conveyance member and attached to the wellhead 10 disposed on the seafloor 20 in a similar manner as set forth herein. Next, the optional packer 205 may be activated. The ported sub 210 may also be activated and used as set forth herein. Additionally, the perforating tool 215 may be used to perforate (or cut) the casing string. The tool 200 may further be used to remove the wellhead 10 in a similar manner as described herein.

Figure 8:
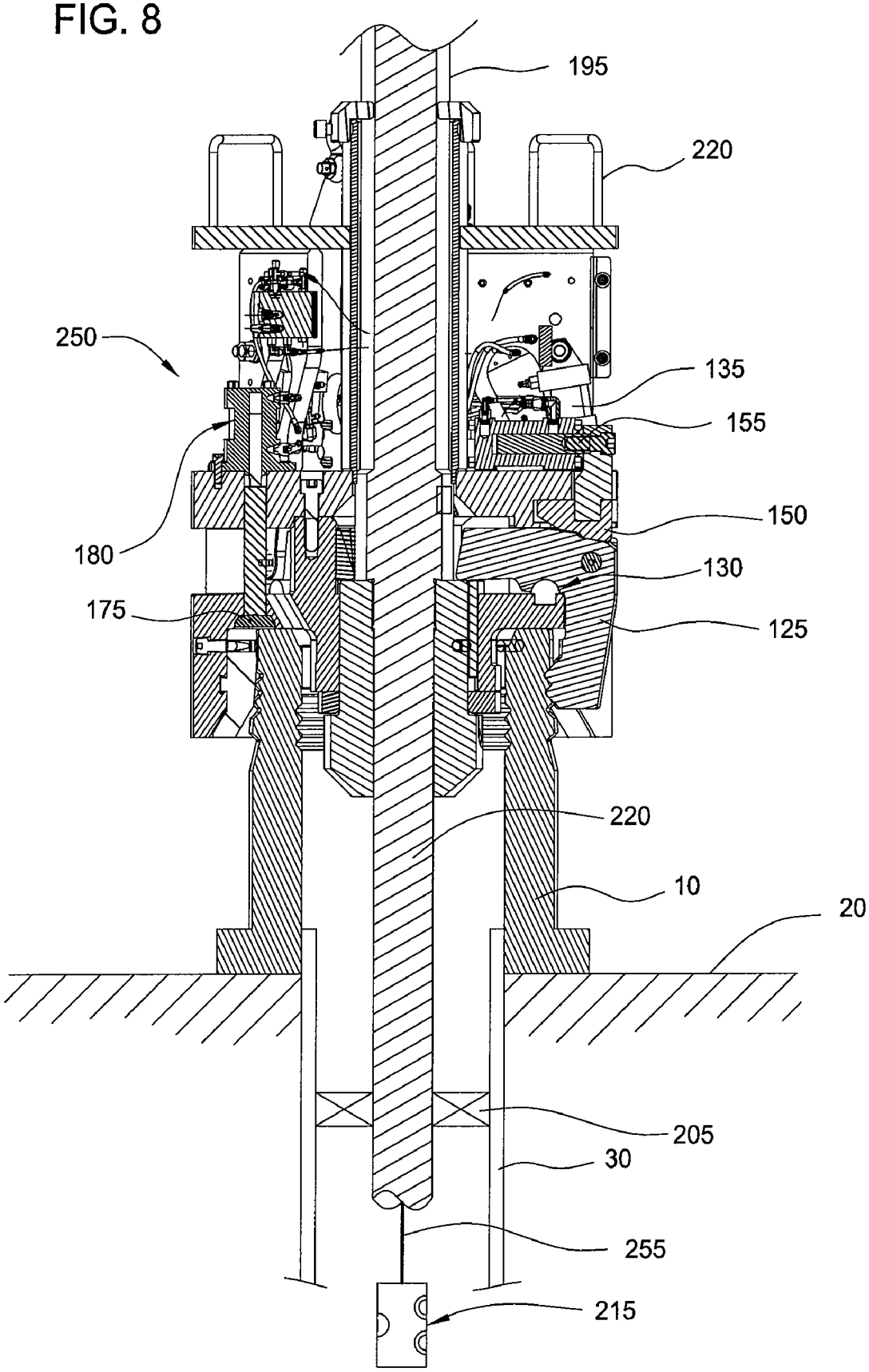
FIG. 8 is a view illustrating a subsea wellhead intervention and retrieval tool with the perforating tool disposed on a wireline.

FIG. 8 is a view illustrating a subsea wellhead intervention and retrieval tool 250 with the perforating tool 215 disposed on a wireline 255. For convenience, the components of the tool 250 that are similar to the components of the tools 100, 200 will be labeled with the same reference indicator. As shown in FIG. 8, the tool 250 has engaged the wellhead 10 in a similar manner as described herein. As also shown in FIG. 8, the perforating tool 215 has been positioned in the casing string 30 by utilizing the wireline 255. This arrangement may be useful if multiple areas are to be perforated by the perforating tool 215. Further, the use of wireline 255 allows the capability of running the perforating tool 215 in and out of the wellbore multiple times (or runs). Additionally, the tubular member 220 is open ended thereby allowing fluid flow to be pumped through the tubular member 220.

In operation, the tool 250 is lowered into the sea via the conveyance member and attached to the wellhead 10 disposed on the seafloor 20 in a similar manner as set forth herein. Next, the optional packer 205 may be activated to create a seal between the tubular member 220 and the casing string 30. Thereafter, the perforating tool 215 may be positioned in the casing string 30 by utilizing the wireline 255 and then activated to perforate (or cut) the casing string. The tool 250 may further be used to remove the wellhead 10 in a similar manner as described herein.

Figure 9:
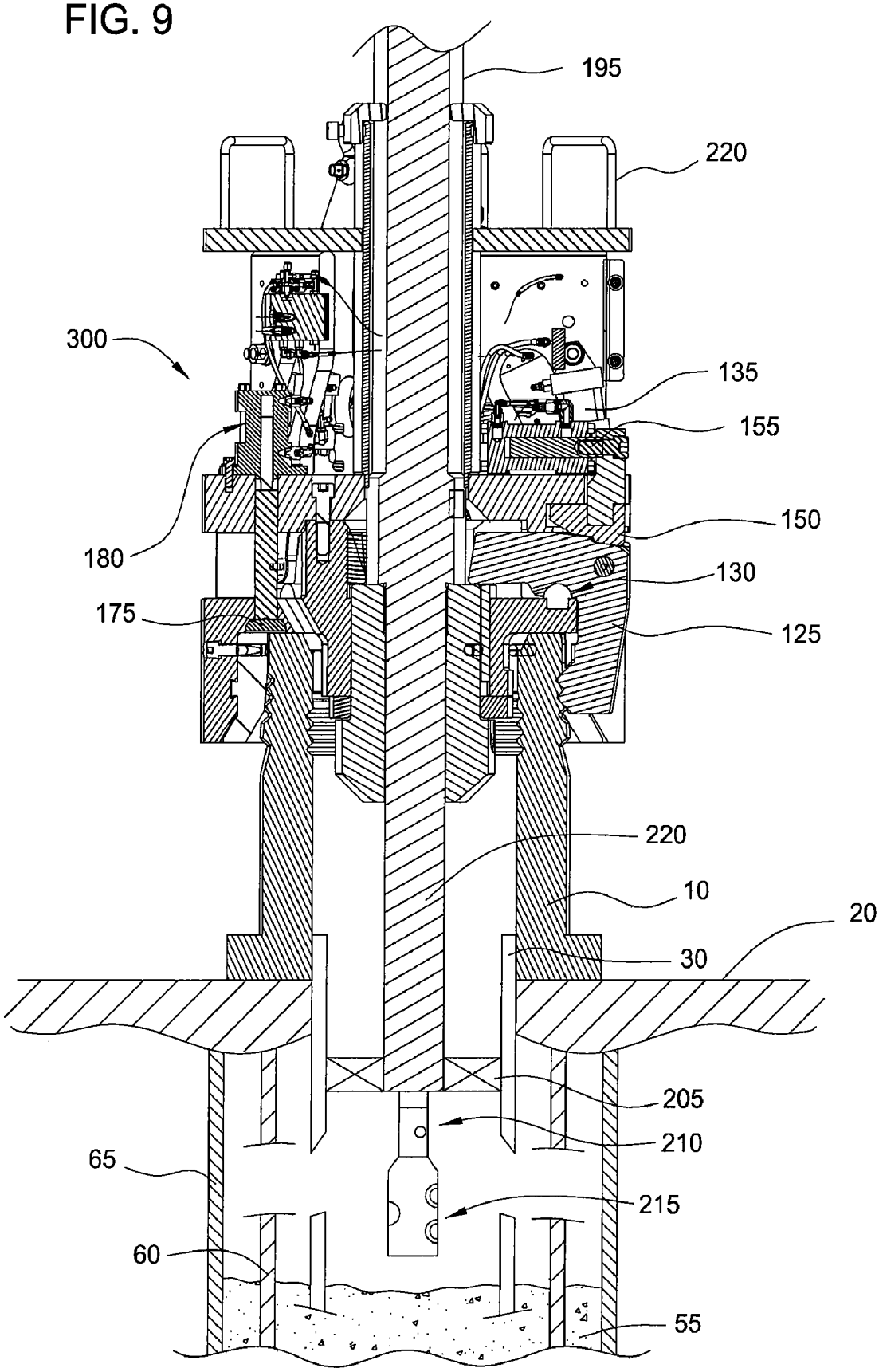
FIG. 9 is a view illustrating a subsea wellhead intervention and retrieval tool with the perforating tool.

FIG. 9 is a view illustrating a subsea wellhead intervention and retrieval tool 300 with the perforating tool 215. For convenience, the components of the tool 300 that are similar to the components of tools 100, 200 will be labeled with the same reference indicator. As shown in FIG. 9, the tool 300 has engaged the wellhead 10 in a similar manner as described herein. The tool 300 includes the ported sub 210 and the perforating tool 215. As set forth herein, the perforating tool 215 may be used to perforate (or sever) the casing string 30 or any number of casing strings, such as casing strings 30, 60. Additionally, the ported sub 210 may be used in a pressure test and/or to distribute cement 55 which is pumped from the surface.

In operation, the tool 300 is lowered into the sea via the conveyance member and attached to the wellhead 10 disposed on the seafloor 20 in a similar manner as set forth herein. Next, the optional packer 205 may be activated and the ported sub 210 may used as set forth herein. Additionally, the perforating tool 215 may be operated to perforate (or cut) the casing string. The tool 300 may further be used to remove the wellhead 10 in a similar manner as described herein.

Figure 10:
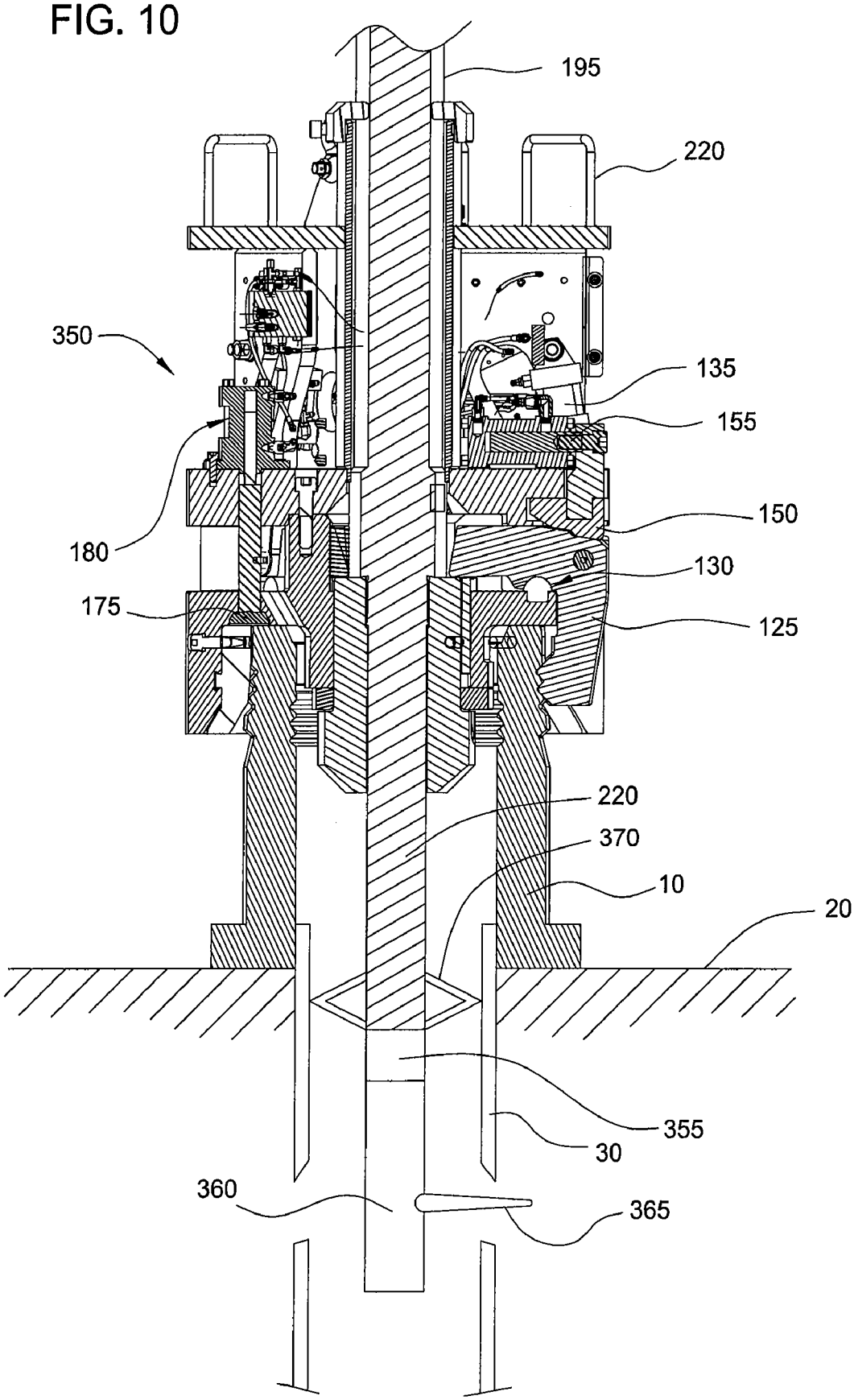
FIG. 10 is a view illustrating a subsea wellhead intervention and retrieval tool with a cutter assembly.

FIG. 10 is a view illustrating a subsea wellhead intervention and retrieval tool 350 attached to a cutter assembly 360. For convenience, the components of the tool 350 that are similar to the components of the tool 100 will be labeled with the same reference indicator. As shown in FIG. 10, the tool 350 has engaged the wellhead 10 in a similar manner as described herein.

The cutter assembly 360 uses a cutting stream 365 to cut the casing string 30. In one embodiment, the cutter assembly 360 is a laser cutter. In this embodiment, the laser cutter would be connected to the surface via a fiber optic bundle (not shown). The fiber optic bundle would be used to transmit light energy to the cutter assembly 360 from lasers on the surface. The cutter assembly 360 would direct the light energy by using a series of lenses (not shown) in the cutter assembly 360 toward the casing string 30. The light energy (i.e. cutting stream 365) would be used to cut the casing string 30 or perforate a hole in the casing string 30.

In another embodiment, the cutter assembly 360 is a plasma cutter. In this embodiment, the plasma cutter would be connected to the surface via a conduit line (not shown). The conduit line would be used to transmit pressurized gas to the cutter assembly 360. The gas is blown out of a nozzle in the cutter assembly 360 at a high speed, at the same time an electrical arc is formed through that gas from the nozzle to the surface being cut, turning some of that gas to plasma. The plasma is sufficiently hot to melt the metal of the casing string 30. The plasma (i.e. cutting stream 365) would be used to cut the casing string 30 or perforate a hole in the casing string 30.

In a further embodiment, the cutter assembly 360 is an abrasive cutter. In this embodiment, the abrasive cutter would be connected to the surface via a fluid conduit (not shown). The fluid conduit would be used to transmit pressurized fluid having abrasives to the cutter assembly 360. The pressurized fluid (with abrasives) is blown out of a nozzle in the cutter assembly 360. The pressurized fluid (i.e. cutting stream 365) would be used to cut the casing string 30 or perforate a hole in the casing string 30. In another embodiment, a chemical or a high energy media may be used with the cutter assembly 360 to cut (or perforate) the casing string 30.

The tool 350 includes an optional rotating device 355 configured to rotate the cutter assembly 360. The rotating device 355 may be controlled at the surface or downhole. The rotating device 355 may be powered by electric power or hydraulic power. Generally the rotating device 355 will rotate the cutter assembly 360 in a 360 degree rotation in order to cut the casing string 30. The speed, direction and the timing of the rotation will also be controlled by the rotating device 355 in order to allow the cutting stream 365 to sever (or perforate) the casing string 30.

The tool 350 may be attached to an optional anchor device 370 to anchor the tool 350 to the casing string 30. The anchor device 370 may include radially extendable members that grip the casing string 30 upon activation of the anchor device 370. Generally, the anchor device 370 is used to stabilize (or centralize) the cutter assembly 360 in the casing string 30.

In operation, the tool 350 is lowered into the sea via the conveyance member and attached to the wellhead 10 disposed on the seafloor 20 in a similar manner as set forth herein. Next, the optional anchoring device 370 may be used to stabilize (or centralize) the cutter assembly 360 in the casing string 30. Thereafter, the cutter assembly 360 may be activated to perforate (or cut) the casing string and the cutter assembly may be rotated by using the rotating device 355. The tool 350 may further be used to remove the wellhead 10 in a similar manner as described herein.

Figure 11:
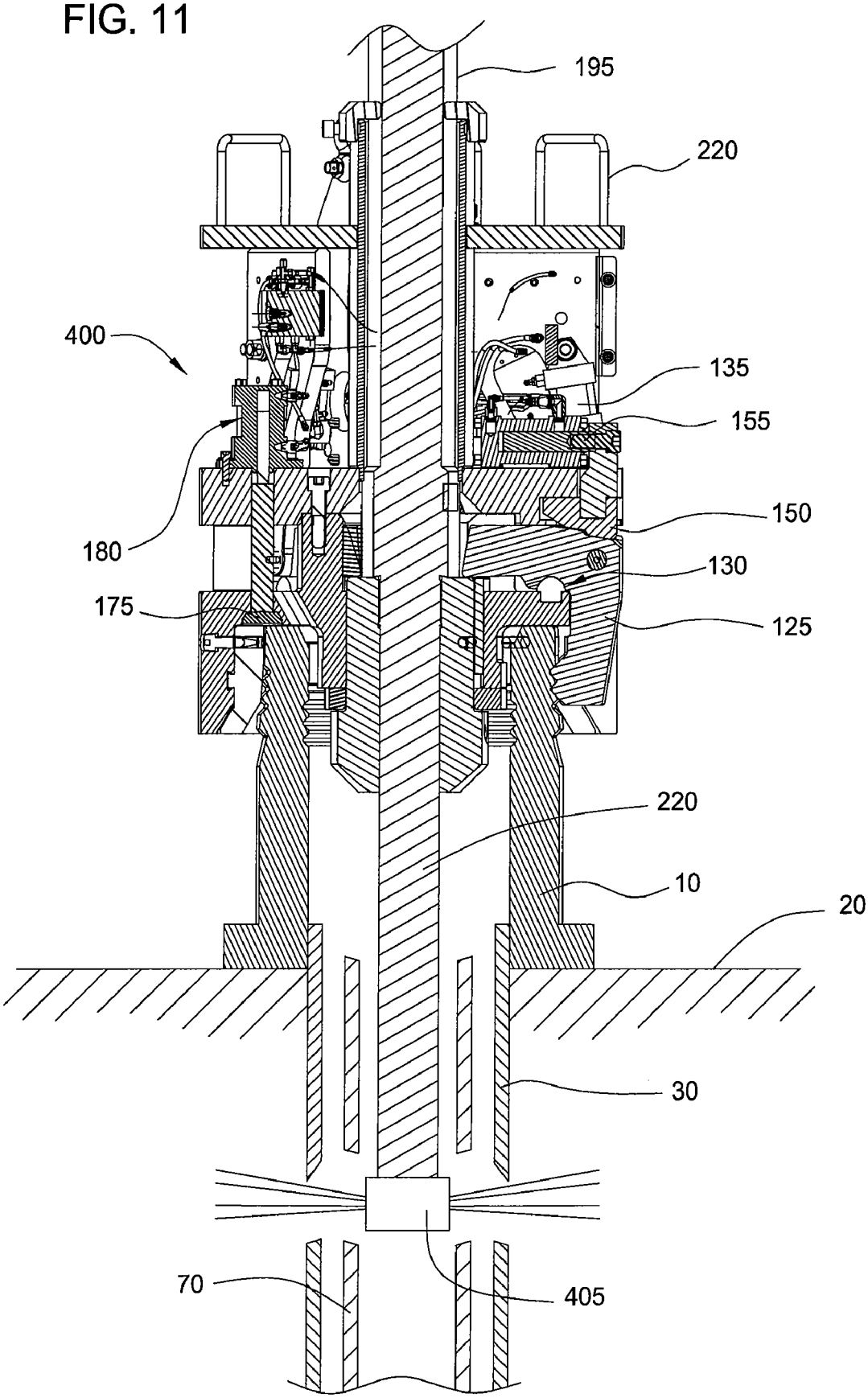
FIG. 11 is a view illustrating a subsea wellhead intervention and retrieval tool with an explosive charge device.

FIG. 11 is a view illustrating a subsea wellhead intervention and retrieval tool 400 with an explosive charge device 405. For convenience, the components of the tool 400 that are similar to the components of tools 100, 200 will be labeled with the same reference indicator. As shown in FIG. 11, the tool 400 has engaged the wellhead 10 in a similar manner as described herein.

The tool 400 includes the explosive charge device 405 for cutting (or perforating) the casing string 30 or any number of casing strings. Generally, the explosive charge device 405 includes several shaped explosive charges that are selectively activated to cut (or perforate) the casing string 30. The explosive charge device 405 may also include a single massive explosive charge. If the casing string 30 is to be cut, the explosive charge device 405 may include a 360 degree charge which will cut (or sever) the casing string 30 upon activation. In the embodiment illustrated in FIG. 11, the explosive charge device 405 is part of the tool 400. It is to be noted, however, that the explosive charge device 405 could be a separate device that is lowered through the tool 405 via a wireline or another type of conveyance member, such as coil tubing, jointed pipe or an umbilical.

In operation, the tool 400 is lowered into the sea via the conveyance member and attached to the wellhead 10 disposed on the seafloor 20 in a similar manner as set forth herein. Next, the explosive charge device 405 may activated to perforate (or cut) the casing string. The tool 400 may also be used to remove the wellhead 10 in a similar manner as described herein.

The subsea tool described herein may be used for subsea well intervention operations, including retrieval of a wellhead from a subsea well. In one embodiment, one or more systems or subsystems of the subsea tool may be controlled, monitored or diagnosed via Radio Frequency Identification Device (RFID) or a radio antenna array. In another embodiment, the components of the subsea tool may be activated by using a RFID electronics package with a passive RFID tag or an active RFID tag. In this embodiment, one or more components in the subsea tool, such as cylinders or an attached downhole assembly such as a cutter assembly, perforating tool, ported sub, anchoring device, etc, may include the electronics package that activates the component when the active (or passive) RFID tag is positioned proximate a suitable sensor. For instance, the subsea tool having a component with the electronics package is lowered into the sea via the conveyance member and positioned proximate the wellhead disposed on the seafloor in a similar manner as set forth herein. Thereafter, the active (or passive) RFID tag is pumped through an umbilical connected to the tool or lowered into the sea. When the active (or passive) RFID tag is detected, the relevant component may be activated. For example, the electronics package in the tool may sense the active (or passive) RFID tag then send a control signal to actuate the gripping arm. The same electronics package may sense another active (or passive) RFID tag and then send another control signal to actuate the wedge block assembly. The same electronics package may sense a further active (or passive) RFID tag and then send a further control signal to actuate the lifting cylinders. In this manner, the tool may be controlled by using the electronics package with the active (or passive) RFID tags. In a similar manner, an electronics package with the active (or passive) RFID tags may be used to activate and control a downhole assembly attached to the tool.

The embodiments describe herein relate to a single subsea wellhead intervention and retrieval tool. However, it is contemplated that multiple subsea wellhead intervention and retrieval tools may be used together in a system. Each subsea wellhead intervention and retrieval tool may be independently powered or linked to a primary subsea power source for simultaneous onsite multiple unit operation.

While the foregoing is directed to embodiments of the present invention, other and further embodiments of the invention may be devised without departing from the basic scope thereof, and the scope thereof is determined by the claims that follow.

The invention claimed is:

1. A method of performing an operation in a subsea well, the method comprising:

positioning a tool proximate a subsea wellhead, wherein the tool has at least one grip member and a lock member, and wherein the tool is attached to a downhole assembly;

moving the at least one grip member from an unclamped position to a clamped position in which the grip member engages the subsea wellhead;

moving the lock member from a first radial distance relative to a centerline of the tool to a second smaller radial distance by hydraulically activating the lock member such that the lock member engages a portion of the grip member thereby retaining the grip member in the clamped position; and performing the operation in the subsea well by utilizing the downhole assembly.

2. The method of claim 1, wherein a tapered edge of the lock member engages a corresponding tapered edge on the grip member upon activation.

3. The method of claim 1, further comprising applying an upward force to the tool thereby enhancing the grip between the grip member and the subsea wellhead.

4. An apparatus for use in a subsea well, the apparatus comprising:

a grip member for engaging a subsea wellhead, the grip member movable between an unclamped position and a clamped position; and a lock member movable between an unlocked position in which the lock member is at a first radial distance and a locked position in which the lock member is at a second smaller radial distance upon activation of a hydraulic cylinder, wherein the lock member in the locked position retains the grip member in the clamped position.

5. The apparatus of claim 4, wherein the lock member is a wedge block that engages a surface of the grip member as the lock member moves to the locked position.

6. The apparatus of claim 4, further including a downhole assembly configured to perform an operation in the subsea well.

7. The apparatus of claim 6, wherein the downhole assembly is a laser device configured to cut at least one casing string.

8. A method of gripping a subsea wellhead, the method comprising:

positioning a tool proximate the subsea wellhead, the tool having at least one grip member;

clamping the tool to the subsea wellhead by moving the at least one grip member into engagement with a profile on the subsea wellhead and locking the at least one grip member by moving a locking member in a radial direction toward a centerline of the tool; and applying an upward force to the tool thereby enhancing the grip between the grip member and the profile on the subsea wellhead.

9. The method of claim 8, wherein applying the upward force to the tool causes an inner mandrel of the tool to contact and apply a force to the grip member, whereby the force is transferred via the grip member to a gripping surface engaged with the profile of the subsea wellhead.

10. An apparatus for use with a subsea wellhead, the apparatus comprising:

a grip member for engaging the subsea wellhead, the grip member rotatable around a pin between an unclamped position and a clamped position;

a lock member configured to retain the grip member in the clamped position, the lock member movable between an unlocked position and a locked position, wherein the lock member moves in a radial direction toward the grip member when the lock member moves from the unlocked position to the locked position; and a cylinder member configured to move the apparatus in an axial direction relative to the subsea wellhead upon activation of the cylinder member, the cylinder member having a shoe that engages the subsea wellhead.

11. The apparatus of claim 10, wherein the cylinder member is positioned on top of the subsea wellhead such that the shoe engages an upper surface of the subsea wellhead.

12. The apparatus of claim 10, wherein the movement of the apparatus in the axial direction relative to the subsea wellhead causes the grip between the grip member and the subsea wellhead to be enhanced.

13. The apparatus of claim 10, further comprising a hydraulic cylinder configured to move the lock member in the radial direction.

14. The apparatus of claim 10, further comprising an inner mandrel configured to apply a force to the grip member to enhance the grip between the grip member and the subsea wellhead.

15. The apparatus of claim 14, wherein the grip member includes a first portion on one side of the pin and a second portion on the other side of the pin.

16. The apparatus of claim 15, wherein the first portion is configured to contact the inner mandrel and the second portion is configured to engage the subsea wellhead.

* * * * *